United States Patent [19]

Heimberger

[11] 4,062,100

[45] Dec. 13, 1977

[54] METHOD OF AND APPARATUS FOR REMOVING COUPLING MEMBERS OF A SLIDE-FASTENER STRINGER FROM A SUPPORT TAPE

[75] Inventor: Helmut Heimberger, Locarno, Switzerland

[73] Assignee: Optilon W. Erich Heilmann GmbH, Cham, Switzerland

[21] Appl. No.: 758,835

[22] Filed: Jan. 12, 1977

[30] Foreign Application Priority Data

Jan. 15, 1976 Germany ..... 2601383

[51] Int. Cl.[2] ..... B21D 53/50; B29D 5/00; B23P 19/00

[52] U.S. Cl. ..... 29/427; 29/408; 29/770

[58] Field of Search ..... 29/408, 427, 770

[56] References Cited

U.S. PATENT DOCUMENTS

| | | | |
|---|---|---|---|
| 2,302,910 | 11/1942 | Johannesmeyer | 29/770 |
| 3,812,573 | 5/1974 | Fukuroi | 29/770 X |
| 3,987,144 | 10/1976 | Nichold | 29/427 X |
| 4,019,240 | 4/1977 | MacFee | 29/408 |

*Primary Examiner*—Milton S. Mehr
*Attorney, Agent, or Firm*—Karl F. Ross

[57] ABSTRACT

Individual coupling members, molded from synthetic resin onto a support tape and straddling an edge thereof are removed, e.g. to enable the mounting of a slider, the stitching of the tape to a fabric or other carrier or for the formation of end-stop members, by applying orthogonal to the stringer plane a pressure causing plastic deformation and flow of the material of the coupling member which results in a spreading of the fastening shanks thereof. The tape is then withdrawn from between the legs or shanks which have been thus spread apart or the coupling member is withdrawn from the edge of the tape generally in the aforementioned plane.

7 Claims, 9 Drawing Figures

FIG. 1
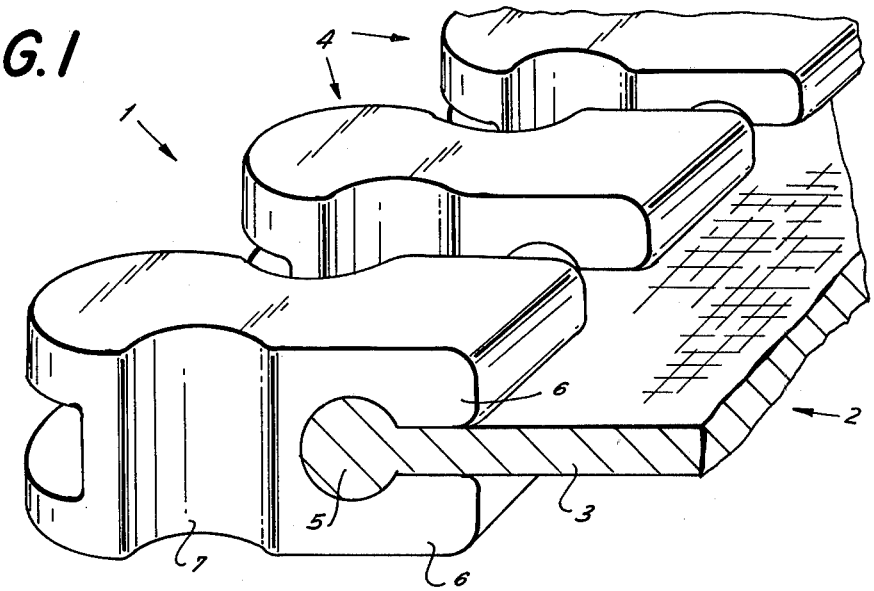
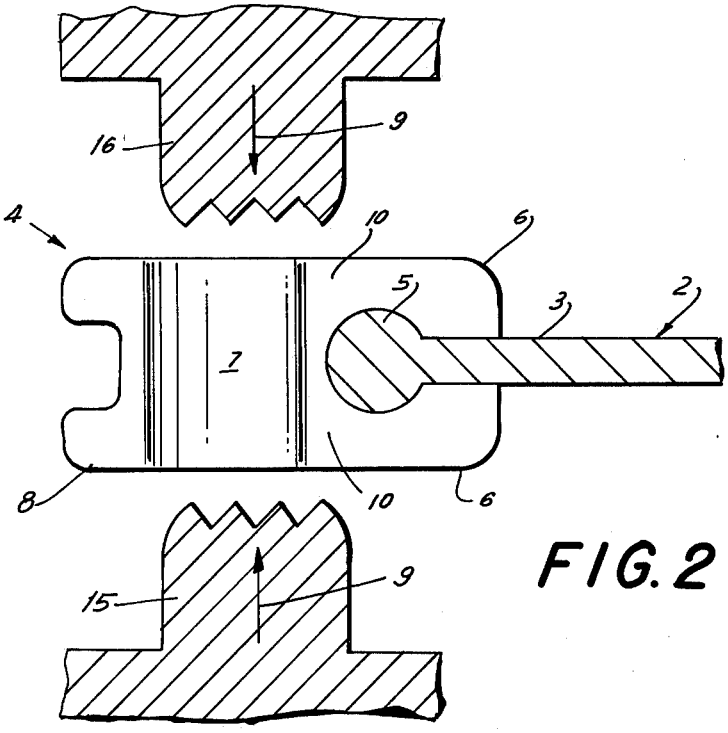
FIG. 2

METHOD OF AND APPARATUS FOR REMOVING COUPLING MEMBERS OF A SLIDE-FASTENER STRINGER FROM A SUPPORT TAPE

FIELD OF THE INVENTION

The present invention relates to a method of and to an apparatus for releasing, i.e. removing, individual coupling members formed from thermoplastic synthetic resin and having fastening shanks or legs which straddle the edge of a stringer tape. More particularly, the invention relates to a method of and an apparatus for removing one or more coupling members of a row thereof, formed by molding on an edge of a support tape to permit a slider to be drawn onto the stringer or for some other purpose.

BACKGROUND OF THE INVENTION

It is known, in the slide-fastener art, to form a slide-fastener stringer or a slide-fastener stringer half by injection-molding a row of separate but identical coupling members or heads onto an edge of a support tape which may be provided with a bead or thickening such that the coupling elements or members have shanks or legs which straddle the bead or thickening and are affixed thereby to the support tape.

In the injection-molding process, a plurality of successive coupling members can be applied to the support tape simultaneously or can be molded thereon in succession. When the stringer half is completed, it is generally juxtaposed with another stringer half to form the stringer, a slider being applied to the stringer to enable the interdigitation or interfitting and separation of the rows of coupling members as the slider is shifted back and forth along the stringer.

It has been found to be necessary and desirable, in many cases, to remove one or more of the coupling members composed of thermoplastic synthetic resin from their support tapes. Such removal is desirable when a gap in a continuously produced stringer is necessary to allow the slider to be mounted upon the stringer, to permit the stringer or slide-fastener half to be secured to a fabric, e.g. of a garment, or for some other purpose, for example the application of endstop members which limit the movement of the slider.

In earlier techniques, the removal of coupling members of thermoplastic synthetic resin from their support tapes has been effected either by heating the coupling member to reduce the strength by which it adheres to the support tape, or by stamping and cutting (punching) systems which slice a portion of the support tape and/or the coupling members from the stringer half.

The heating step reduces the retention force with which the thermoplastic synthetic resin coupling member grips the support tape and hence either eliminates or reduces the clamping force by which the shanks or legs engage the tape. The heated coupling member can then be drawn off the tape.

In the stamping and cutting process, the interdigitating portions of the coupling members may be cut from the remainder thereof and, if necessary, the thermoplastic synthetic resin in the region of the crotch of the fastening shanks is removed so that the latter can be drawn off the tape.

Both these conventional techniques have been found to be disadvantageous. On the one hand, the thermoplastic synthetic resin is a poor heat conductor so that the heating of the coupling elements to a state in which they are rendered plastic, i.e. are sufficiently soft to enable their withdrawal, by convective heat transfer, is time-consuming. Heating by means of high frequency or ultrasonics is likewise costly. The stamping and cutting (punching) approach has the disadvantage that the section of the support tape in the region of the punching operation is damaged, especially when the punching tool becomes dull.

In order to explain the purposes of the coupling-member removal operation in greater detail, it can be observed that such slide fasteners are used mainly for military uniforms and sports garments. The slide fastener must be of the required length for the particular garment but is economically produced substantially continuously. In the production of such slide fasteners, the support tape is fed with a thickened edge or edge bead, through a die, and thermoplastified material is injection-molded in forms disposed at this bead so that the thermoplastic material flows around the edge of the support tape to produce a coupling member straddling same. The early attempts at such operations could only produce stringer halves of a length of 20 to 30 cm. However, with improved injection molding technology, it is now possible to operate substantially endlessly, whereby extremely long stretches of support tape can be passed through the die and successive coupling members applied thereto without interruption. Such manufacturing techniques are highly economical and relatively simple, permit coils of the stringer to be stored conveniently and to be cut into desired length only upon demand or need.

Nevertheless, the disadvantage of the continuous production of slide-fastener stringers is that the sequence of coupling members must be interrupted at given locations to enable respective sliders to be applied and to facilitate stitching of the stringer to a garment, etc. It is for this reason that systems for removing coupling elements have been investigated in the past.

OBJECTS OF THE INVENTION

It is the principal object of the present invention to provide a process for removing the coupling members of thermoplastic synthetic resin from their support tapes and an improved apparatus for carrying out this process.

Another object of the invention is to provide an improved method of and apparatus for the removal of individual synthetic resin coupling members, molded onto the beaded edge of a support tape, from the latter without time-consuming or complicated heating and without the stamping or punching process heretofore used with their respective disadvantages.

It is another object of the invention to provide a method of and an apparatus for removing individual molded coupling elements from a support tape in a manner which can be automated, i.e. carried out substantially automatically with a minimum of supervision and at relatively low cost.

SUMMARY OF THE INVENTION

The invention is based upon my discovery that, quite surprisingly in view of the manner in which the individual coupling elements are molded onto the beaded edge of a support tape so that their shanks straddle the support tape and the bead, the coupling elements or members can be removed by applying pressure to them transversely to the plane of the support tape and thereby causing flow of the synthetic resin material such that the shanks spread apart and enable the coupling member to be drawn laterally away from the support tape or the support tape to be drawn laterally away from the coupling member. This relative displacement of the coupling member and the tape, effected in the plane of the latter, can be accomplished with ease once the shanks are spread apart by the application of pressure in the manner mentioned.

More specifically, the method of the present invention provides for the application of pressure orthogonal to the slide-fastener plane upon the coupling member to be removed in the region thereof, projecting beyond the edge of the support tape and adapted to interfit with the coupling members of the other slide-fastener half to cause flow of the synthetic resin material and spreading of the fastening shanks or legs which straddle the bead of the support tape. Thereafter, the relative movement of the spread coupling member and the tape withdraws the coupling member from the tape or the tape within the coupling member.

According to a preferred embodiment of the invention, the pressure is applied to the coupling member at a point substantially half-way along the length thereof, i.e. at the mid-point of the portion of the coupling member which projects beyond the edge of the tape and over substantially half the length thereof beginning in the region of the crotch of the fastening shanks. A deformation of the coupling heads, i.e. the extremities of the coupling members remote from their shanks, is thus not necessary or even desirable. The pressure is applied, according to the invention by pinching this central portion of the coupling member between two portions of a tool.

The invention is based upon the discovery that the application of pressure in this manner causes a flow of the synthetic resin material, i.e. a flow deformation thereof, which, rather than increasing the clamping action, causes the fastening shanks of the coupling member to spread apart and disengage from the support tape. This is all the more effective when the support tape has a fastening bead and in spite of the adhesive bond of the coupling member to the support tape resulting from the molding of the coupling element therearound in a thermoplastic state. Flow deformation, according to the invention, means a plastic deformation of the portion thereof engaged between the opposite surfaces of the tool such that the material extrudes laterally away from the compression region. It is this phenomenon which results in the spreading of the fastening shanks.

The advantages obtained with this system of the present invention are numerous. Firstly, it permits the removal of the coupling member without the application of heat which has hitherto been deamed to be necessary to reduce the force with which the shanks engage the support tape. Secondly, stamping or punching and cutting operations are eliminated and there is no possibility of damage to the support tape in the region in which the coupling members are removed.

While flow deformation of thermoplastic synthetic resin materials has been used heretofore to impart a desired shape to the coupling members, I have found that flow deformation in the manner described can be used effectively for removal of the coupling members by spreading of the shanks. This effect is hardly to be expected. It is of special significance that the process according to the invention can be carried out with a simple device or apparatus and even completely automatically to minimize the amount of supervision required.

BRIEF DESCRIPTION OF THE DRAWING

The above and other objects, features and advantages of the present invention will become more readily apparent from the following description, reference being made to the accompanying drawing in which:

FIG. 1 is a diagrammatic perspective view of a portion of a slide fastener half, having coupling elements molded onto the edge of a support tape;

FIG. 2 is a cross-sectional view diagrammatically illustrating a portion of an apparatus for carrying out the process of the invention;

SPECIFIC DESCRIPTION

Figure 3:
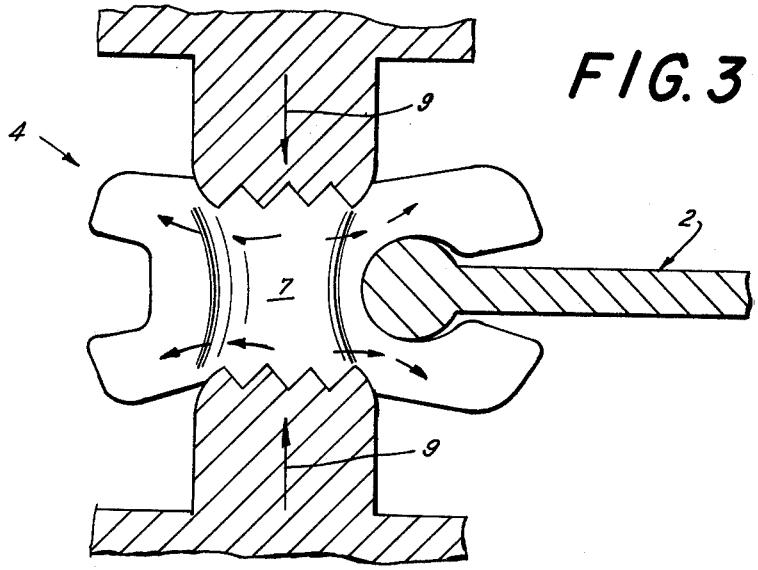
FIG. 3 is a view similar to FIG. 2 showing the beginning of the spreading operation.

FIG. 1 shows a portion of a slide-fastener half 1 which comprises a support tape 2 formed as a web 3 and a bead 5 along its edge (see my application Ser. No. 728,133 filed 30 Sept., 1976 and copending herewith). The slide-fastener half 1 illustrated in FIG. 1 is the right-hand member of a slide-fastener stringer whose coupling members 4 are adapted to interdigitate upon movement of a slider therealong.

The coupling members 4 are injection-molded from thermoplastic synthetic resin around the beaded edge of the web 3 so that fastening shanks 6 straddle the bead and engage the support tape. The shanks 6 are integral with a portion 7 (projecting portion) which extends beyond the edge of the tape 2. The portion 7 is provided on its free extremity with an enlarged head 8 adapted to be received between the coupling member 4 of the other slide-fastener half. While all of the length of the projecting portion 7 can be received within the interstices of the other stringer half, the term "projecting portion" is intended to include members of a length which exceed the portions which actually can be received between pairs of coupling members of the other slide-fastener half.

Figure 4:
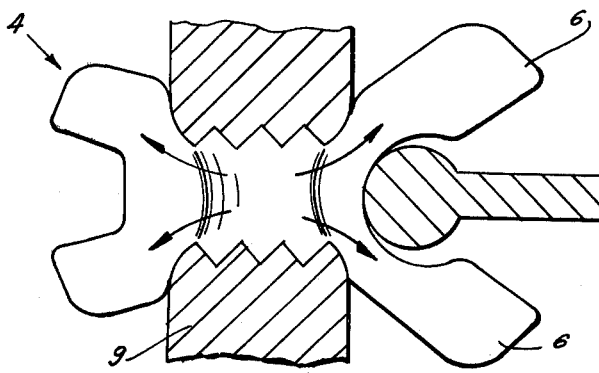
FIG. 4 is a view similar to FIG. 2 and 3, illustrating the spreading of the shanks upon the completion of the flow deformation.
Figure 5:
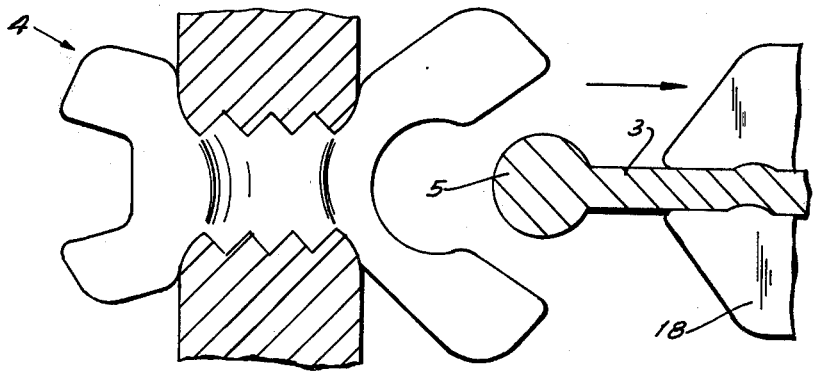
FIG. 5 is a similar view, illustrating the withdrawal of the support tape from the coupling element having spread apart shanks.

As a comparison of FIGS. 2 and 3 will indicate, the center of the coupling member, i.e. approximately half the length thereof beginning with the junction 10 of the projecting portion 7 with the shanks 6 and corresponding to the crotch between the shanks 6 can be subjected to pressure orthogonal to the plane of the support tape (arrows 9) between a pair of tool members 15 and 16. When pressure is applied in this fashion, material is caused to flow as shown by the arrows within the outline of the coupling member in FIG. 3, to bring about a spreading of the shanks (FIG. 4), whereupon the tape 2 can be withdrawn by the jaws of a gripper 18. Naturally, the member 4 having spread apart shanks 6 can be withdrawn from the tape if the latter is held stationary by movement in the opposite direction. While the pressure can also be applied up to the coupling head 8, I have found that best results are obtained when the pressure is limited to the intermediate region of the coupling element beginning at the aforementioned crotch. Pressure reaching to the head can be advantageous when two interconnected slide-fastener halves are subjected simultaneously to the pressure to release coupling elements of both support tapes; in this case the tools 15 and 16 can bridge the two slide-fastener halves.

Figure 6:
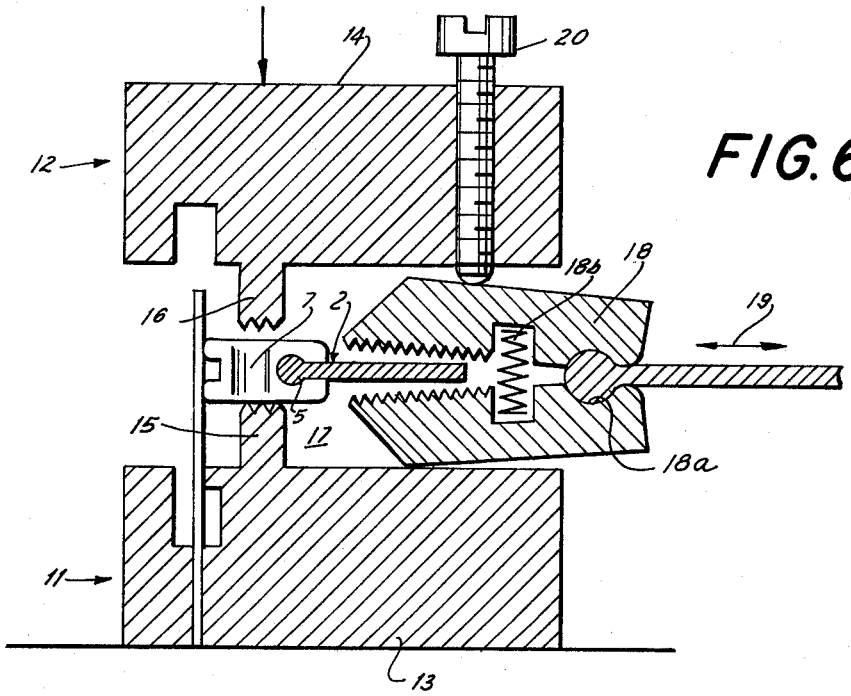
FIG. 6 is a vertical cross-sectional view through a press apparatus for carrying out the process of the invention.
Figure 7:
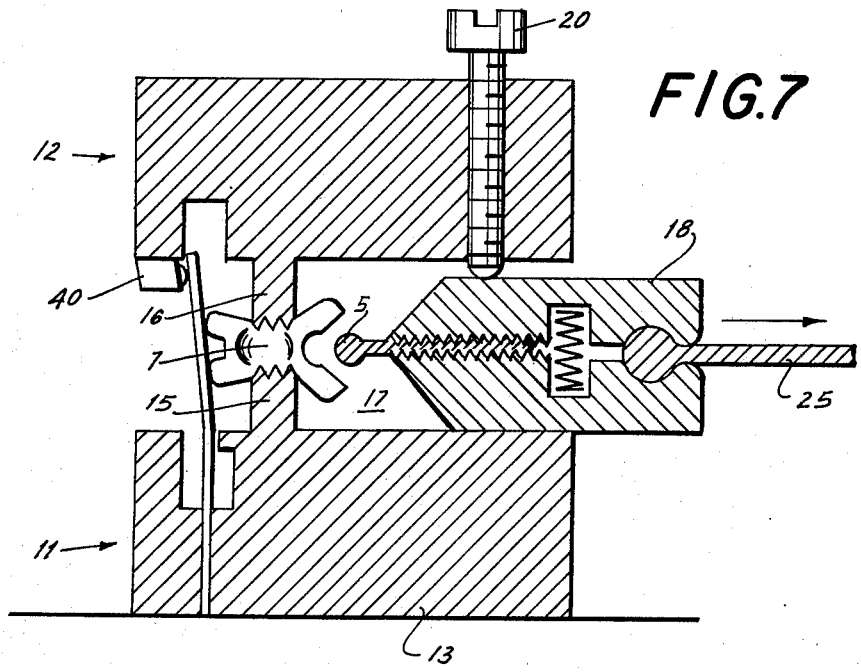
FIG. 7 is a view similar to FIG. 6 showing the device in another operating position.

FIGS. 6 and 7 illustrate in somewhat greater detail, although diagrammatically, a relatively simple device or apparatus for carrying out the process of the present invention. The apparatus is basically formed as a press which can have a fixed press table 11 and a movable press beam 12. The latter can be formed as a press block because of the small size of the press which is necessary. In each of the figures of the drawing the relevant parts have been greatly enlarged for clarity.

Figure 8:
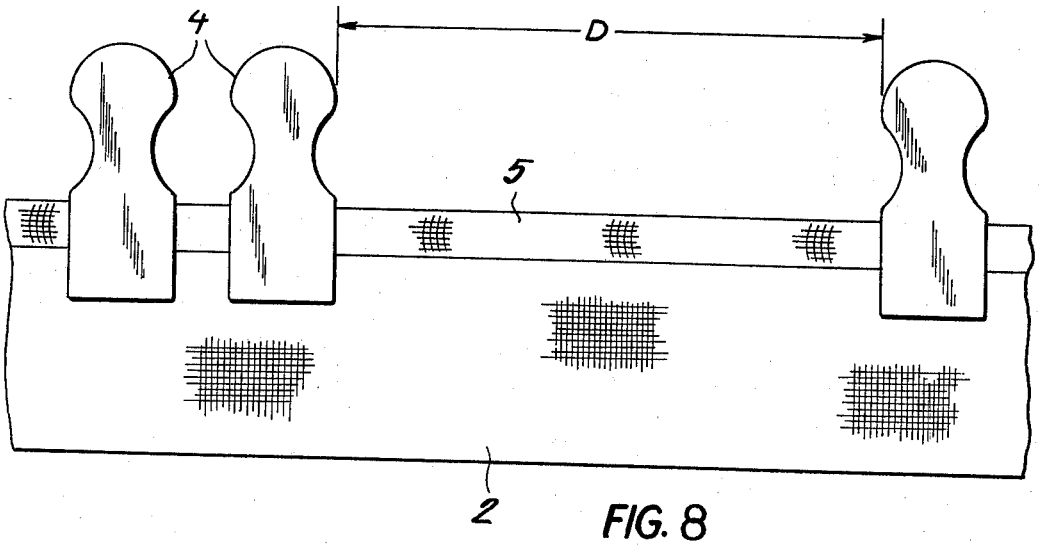
FIG. 8 is a plan view of a portion of the stringer half from which several coupling members have been removed.

The press table 11 and the press block 12 are provided with the pressing dies or tools 13 and 14, respectively, the tools carrying the pressing projections 15 and 16 mentioned previously and which can be serrated in the regions in which they engage the projecting portion 7 of the coupling member 4. In addition, the apparatus includes a gripper 18 which is movable laterally (arrow 19), i.e. parallel to the stringer plane. The gripper 18 is adapted to seize the tape 2 and withdraw the latter from the coupling member when the shanks thereof have been spread apart. The pressing members 15 and 16 can bridge as many coupling members as it may be desirable to remove in a single operation. In the case of the assembly shown in FIG. 9, for example, four coupling members are removed at a time. FIG. 8 shows a portion of the tape in which three coupling members have been removed to leave a region D at which a slider can be slid over the stringer half thus produced.

According to the invention, the apparatus shown in FIGS. 6 and 7 can be provided with means, e.g. a switch 40, for automatically triggering the withdrawal of the gripper 18 to the right once the coupling member 4 has been spread. The device can also be automated, i.e. provided with a transport system for advancing a particular length of the slide-fastener half through the press block as illustrated in FIG. 9 for reduced personnel supervision of the system.

Figure 9:
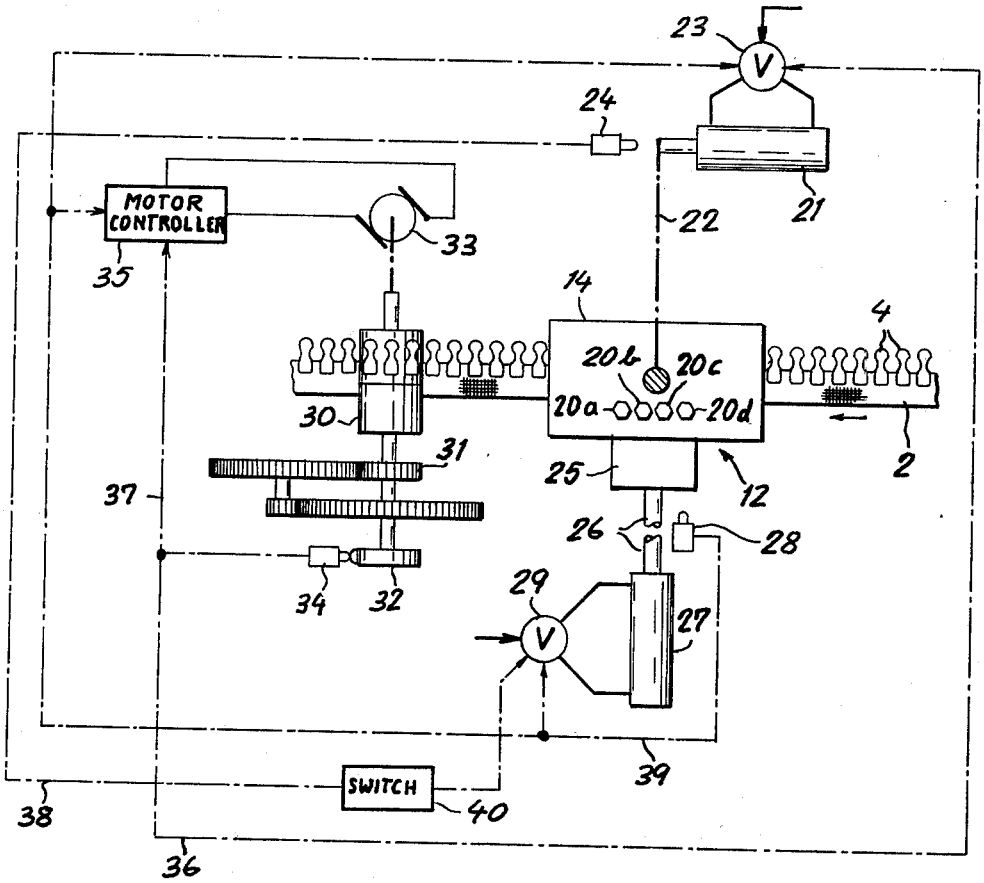
FIG. 9 is a diagram, in plan view, illustrating an automatic apparatus for carrying out the present invention.

In FIG. 9, I have shown the press block 12 to be equipped with 4 screws **20*a* through 20*d* each of which, like the screw 20, bears upon the jaws of the gripper of an associated gripper member 18. The jaws are normally spread apart by a spring 18*b* and are swingably mounted via grooves 18*a* surrounding a bead 25*a* on a plate 25 adapted to withdraw the grippers 18 once the screws 20** have closed them upon the tape.

In the automatic apparatus of FIG. 9, the plate 25 is displaceable by the piston rod 26 of a pneumatic cylinder 27 operated by a multiposition valve 29 which can be triggered, e.g. by electrical signals inter alia via the switch 40. A limit switch 28 responds to full withdrawal of the plate 25 to trigger, via line 39 and the controller 35, a motor 33 which drives a transport wheel 30 for advancing the tape 2 with the coupling members 4 thereon through the press unit. The drive member 30 is provided with a gear arrangement 31 which operates a cam 32 when a given length of slide-fastener half has traversed the press to trip a switch 34 which operates a valve 23 to actuate a pneumatic cylinder 21 connected as shown at 22 to the movable press platen 14. When the press platen 14 is fully lowered (corresponding to the position shown in FIG. 4), a limit switch 24 is tripped to energize the switch 40 and permit operation of cylinder 27 for withdrawal of the plate 25. The limit switch 28 can also start the motor 33 through the controller 35.

It will be apparent that the device of FIG. 9 is fully automatic and requires no supervision. When the limit switch 28 starts the motor 33, it can also operate the valve 23 to lift the upper press platen. Any other convenient method of coupling the drive or transport device to the press can also be employed.

I claim:

1. A process for removing coupling members molded onto an edge of a support tape of a slide-fastener stringer half, said coupling members having shanks straddling said edge and projecting portions projecting beyond said edge, said method comprising the steps of:

applying pressure to each of the members to be removed in a direction orthogonal to the plane of said slide-fastener half sufficient to cause flow of the material of the pressed member and spreading of the shanks thereof; and relatively displacing the coupling member with its spread-apart shanks and the edge of said tape to withdraw said edge from the coupling member to which the pressure is applied.

2. The method defined in claim 1 wherein said coupling element having spread-apart shanks is held stationary and said tape is displaced in its plane out of the space between the spread-apart shanks.

3. The method defined in claim 1 wherein said tape is held stationary and the coupling member with spread-apart shanks is shifted in the plane of said tape away from said edge to disengage the member from the tape.

4. The process defined in claim 1 wherein the pressure is applied to the coupling member over approximately half the length of said projecting portion beginning at the junction of said shanks therewith.

5. An apparatus for removing a coupling member from a support tape wherein said coupling member has been molded onto an edge of said tape and has shanks straddling said edge and a projecting portion extending beyond said edge of said tape, said apparatus comprising:

a fixed pressing table, a movable pressing block displaceable relative to said table, a tool received between said block and said table and having respective projections bearing upon opposite sides of said member in a direction orthogonal to the plane of said tape upon displacement of said block toward said table, and means for laterally separating said member and said tape upon the spreading of said shanks by the pressure applied to said member by said projection.

6. The apparatus defined in claim 5 wherein the last-mentioned means includes a gripper engageable with said tape and controlled by the displacement of said tool for withdrawing said tape from between the spread-apart shanks.

7. The apparatus defined in claim 5 further comprising a transport means for advancing said tape through said tool and control means for operating said transport device in the cadence of movement of said press table.

* * * * *